United States Patent [19]

Thoelen, Sr.

[11] 4,017,331

[45] Apr. 12, 1977

[54] SWIMMING POOL CLEANING APPARATUS

[76] Inventor: Walter P. Thoelen, Sr., 15 Kamm St., Pequannock, N.J. 07440

[22] Filed: Feb. 12, 1976

[21] Appl. No.: 657,569

[52] U.S. Cl. ..... 134/167 R; 239/601

[51] Int. Cl.[2] ..... B08B 3/02

[58] Field of Search ..... 210/169, 60; 134/167 C, 134/167 R, 168 C; 4/172, 172.15; 23/267 A; 285/361; 239/601, 602

[56] References Cited

UNITED STATES PATENTS

| | | | |
|---|---|---|---|
| 2,072,976 | 3/1937 | Andrus | 23/267 A |
| 2,999,644 | 9/1961 | Nobinger | 239/602 |
| 3,032,044 | 5/1962 | Pansini | 134/111 |
| 3,074,078 | 1/1963 | Varian | 4/172 |
| 3,139,099 | 6/1964 | Anthony | 15/1.7 |
| 3,168,896 | 2/1965 | Berg | 15/1.7 X |
| 3,261,371 | 7/1966 | Vernon | 15/1.7 |
| 3,295,540 | 1/1967 | Ortega | 15/1.7 |
| 3,687,375 | 8/1972 | Griffiths | 239/601 |
| 3,769,993 | 11/1973 | Schaffer | 134/167 R |
| 3,776,464 | 12/1973 | Proffit | 15/1.7 |
| 3,797,508 | 3/1974 | Jacobs | 134/167 R |
| 3,817,382 | 6/1974 | Arneson | 210/169 |
| 3,820,172 | 6/1974 | Kane | 4/172.15 |
| 3,937,399 | 2/1976 | Halley | 23/267 A |

*Primary Examiner*—Theodore A. Granger

[57] ABSTRACT

A swimming pool cleaner of the pressurized water actuated, random sinuous motion, sweeping arm type is disclosed which agitates silt and other particulate debris, thereby facilitating their removal by conventional pump-driven recirculating filtering means. The random sinuous motion of the immersed sweeping arms is greatly enhanced by unique compound water discharge jets which efficiently convert water head into sweeping arm motion. The discharge jets further greatly reduce frictional wear of the sweeping arms caused by abrasion against the interior surfaces of the pool, and provide a distributed water scrubbing action of the interior pool surfaces. The compound water discharge jets are further configured to minimize the possibility of stalling of the sweeping arms due to their finding a position of static equilibrium. The apparatus and method described are equally suitable for use in industrial processes where it is desirable to provide agitation of a liquid by simple and economical means.

10 Claims, 9 Drawing Figures

SWIMMING POOL CLEANING APPARATUS

BACKGROUND OF THE INVENTION

1. Field of the Invention

The present invention relates to automatic swimming pool cleaning apparatus and more particularly to improvements in such cleaners utilizing flexible conduit sweeping arms to agitate silt and particulate debris which accumulates in pools. The flexible conduits of the instant invention exhibit a high degree of motional and scrubbing efficacy due to their compound water discharge means, thereby greatly enhancing their silt agitating ability so as to maintain the silt in suspension and facilitating its removal by well known pump-driven recirculating filtering systems.

2. Description of the Prior Art

In recent years, a considerable amount of effort has been directed towards providing swimming pool cleaning devices of various types. The effort continues even now, to meet the new requirements evolving as this popular recreational form receives wider use due to the emergence of inexpensive pools, and progressively simpler types of pool installations. These new requirements arise from a need for lower cost cleaning devices of substantially portable configurations which may be easily installed and removed without complex or critical adjustments, or special tools.

The earlier prior art discloses a number of hand-manipulated vacuuming devices and methods, used periodically for cleaning the pool water. More recently, a number of automated devices have been disclosed showing a change towards the inclusion of random sinuous motion silt agitation means in conjunction with the well known water recirculating pumping and filtering systems. Pool cleaning systems which employ a combination of random sinuous motion, silt agitation means with conventional pump-driven recirculating/filtering systems, while representing a practical solution to the problem, also have disadvantages which have slowed their widespread acceptance. Typical prior art devices of this type include complex float-supported valve switching mechanisms for reversing the flow of pressurized water, thereby both propelling and guiding their pendently suspended flexible conduit, silt agitating means over the expanse of the pool. Examples of such embodiments may be found in U.S. Pats. to Ortega, Nos. 3,295,540; and to Winston et al, 3,170,180. Other prior art systems of the combination type teach the use of rigid structural members (including mechanically oscillated members) to suspend the flexible conduit into the pool. Exemplary prior art of these latter types are found in the Blumenfeld U.S. Pat. No. 2,191,207 and the Pansini U.S. Pat. No. 3,032,044. All of these prior art devices, including a much simpler embodiment disclosed in the Varian U.S. Pat. No. 3,074,078, have the severe disadvantage of causing excessive frictional wear of the flexible conduit as it traverses throughout the pool. Additionally, they either include complex mechanisms to preclude their becoming stalled, or simply ignore the stalling problem — in either case causing the devices to perform far less than optimally.

Other disadvantages of the devices disclosed in the related prior art arise from the manner in which the pressurized water is discharged. Flexible conduit arms having only a single discharge nozzle at their outer extremity for propulsion agitate silt mostly by the abrading, wiping action of the arms, and only incidentally by the expulsion of pressurized water from the discharge nozzle. Silt agitation by the nozzle is therefore restricted to the region immediately adjacent to the outlet.

SUMMARY OF THE INVENTION

Therefore, it is a primary object of the present invention to provide improved apparatus for automatically cleaning swimming pools by providing highly efficient means for agitation of the silt therein, which silt is then removed by the existing pump-driven recirculating filtering system.

A further object of the present invention is to provide a simple and economical flexible conduit for the agitating of silt in a swimming pool, or more generally for agitating particulate debris or sedimentation in a container of fluid, wherein the wear on the flexible conduit due to frictional abrasion against the interior surfaces of the pool, or fluid container, is substantially eliminated.

A yet further object of the present invention is to provide a flexible conduit for use with swimming pool cleaning apparatus, or more generally for agitating particulate debris or sedimentation in a container of fluid, having an end discharge means of simple design which greatly reduces the tendency of the flexible conduit to settle into a rest position and become stalled.

A further object of the present invention is to provide a flexible conduit for use in a swimming pool cleaner, wherein the pressurized water scrubbing action is achieved by discharge means which are distributed along the length of the flexible conduit.

A still further object of the present invention is to provide a flexible conduit which is highly efficient in translating the kinetic energy contained in a source of pressurized fluid into sinuous random motion of the flexible conduit, and wherein discharge of the pressurized fluid flow is used to randomly propel the flexible conduit; to scrub by fluid flow scouring the contiguous pool, or fluid container, interior surfaces; and further to maintain the flexible conduit slightly displaced from the interior surfaces.

These objects as well as additional features and advantages of the present invention will become apparent to those skilled in the art as the description proceeds with reference to the accompanying drawings wherein.

DETAILED DESCRIPTION OF THE PREFERRED EMBODIMENTS

Figure 1:
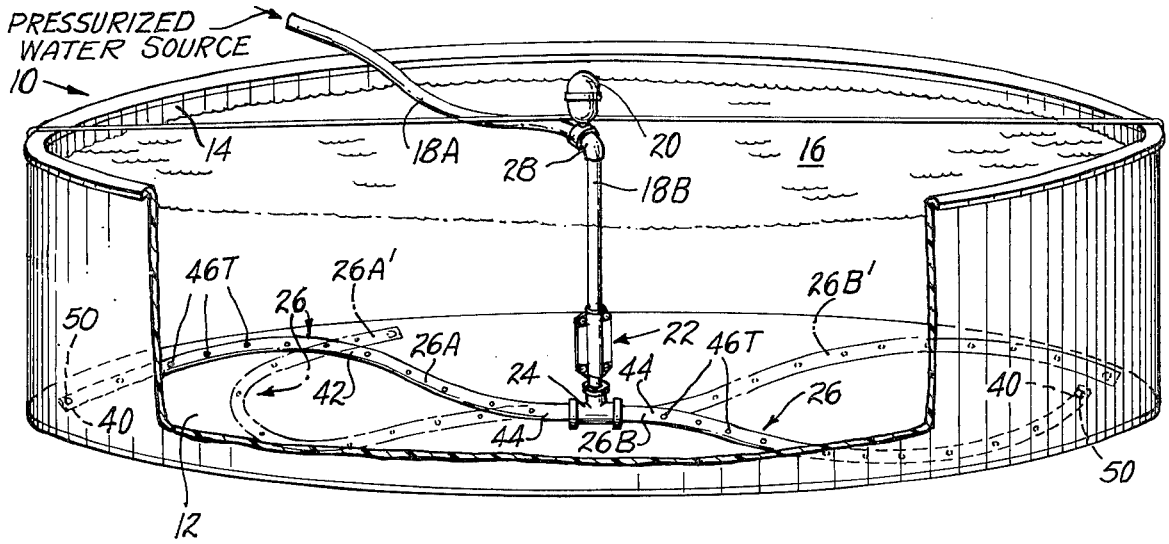
FIG. 1 is a perspective view of a swimming pool, partly in section, showing a preferred embodiment of the swimming pool cleaner of the present invention installed therein.

Referring to FIG. 1, a preferred embodiment of the swimming pool cleaning apparatus in accordance with the present invention is shown installed in a typical circular swimming pool. The pool is indicated generally at 10, having a bottom 12, circular sides 14 and filled with water 16 to a convenient level. Hereinafter, the bottom 12 and sides 14 will, when appropriate, be collectively referred to as the interior surfaces of the pool. It should be noted that pool size and shape as shown is merely an exemplary configuration, as the pool cleaning apparatus is equally suitable for use with a wide variety of pool shapes and types. Included in this variety would be the well known rectangular and oval shapes as well as pools of the permanently installed, below ground, and the portable, above ground, types. The major elements of the pool cleaning apparatus are a feedhose 18, shown as a single hose comprised of two regions 18A and 18B; a float assembly 20; a weight assembly 22; a diversion valve 24; and a pair of sweeping arms 26A and 26B. Hereinafter, the sweeping arms will, when appropriate, be collectively referred to as flexible conduits 26. As shown, the intake end of the feedhose 18A is connected to a source of pressurized water (not shown) and the feedhose 18A is then further threaded through an elbow shaped retaining means 28 attached to the float assembly 20. The length of feedhose 18A is adjustably set such that the float assembly 20 is positioned nominally in the central zone of the pool. Thereafter, the feedhose 18B is positioned to extend vertically downward to the bottom of the pool, maintained there by the weight assembly 22. The length of feedhose 18B is adjustably set to correspond to the depth of the water in the pool. The feedhose 18 and the flexible conduits 26 may be made of any of the well known, commerically available, flexible plastic or vinyl materials of the thin-walled, extruded types. In use, the length of the feedhose 18 is made slightly greater than the combined radius and depth of the pool; the float assembly 20 and the weight assembly 22 are slidably adjusted to position the apparatus substantially as shown in FIG. 1. Both adjustably positioned assemblies are maintained in their desired relative positions by simple frictional retaining means. Thus it is seen that a fairly simple arrangement is used to accomodate pools of a variety of dimensions and water depths.

The feedhose 18B is coupled to the diversion valve 24, such as a T-shaped fitting, which functions to provide predetermined amounts of pressurized water flow to the flexible conduits 26. The unique features associated with the water discharge means of the flexible conduits 26 will be further described in detail hereinbelow. For the purposes of a simplified, general description, the flexible conduits 26 may be considered as having nozzles at their free extremeties and, by virtue of the reaction forces produced by the pressurized water exiting therefrom, are propelled in random and sinuous motion in the vicinity of the bottom of the pool.

Figure 2:
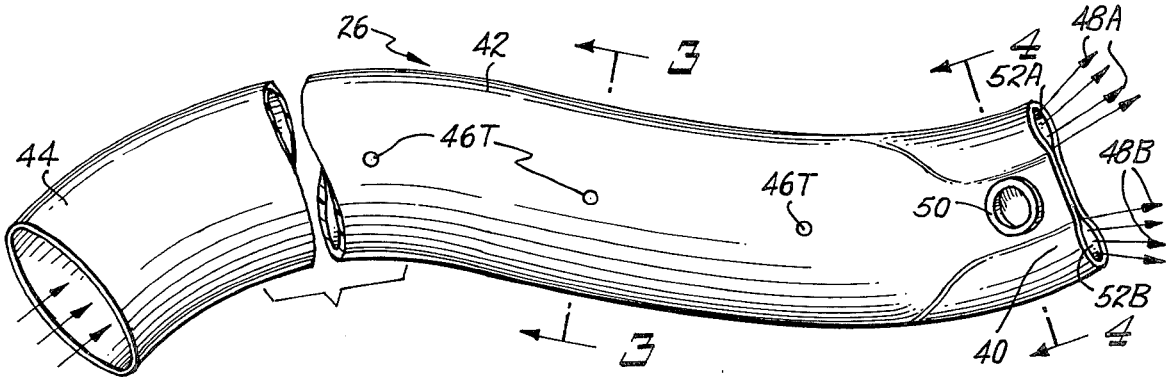
FIG. 2 is an enlarged fragmentary top view of the flexible conduit showing the jet openings distributed along the length thereof, and also the arrangement of the end jet nozzle.
Figure 3:
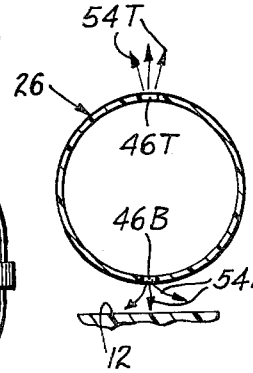
FIG. 3 is a transverse sectional view through the flexible conduit of FIG. 2, taken on the line 2—2 thereof.
Figure 4:
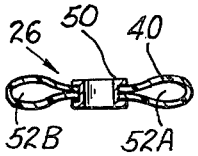
FIG. 4 is a transverse sectional view through the end of the flexible conduit, taken on the line 4—4 of FIG. 2.

Referring now to FIGS. 2-4, the unique features of the flexible conduit 26 are illustrated. The conduit is shown as having a propulsion end 40, a central portion 42 and an input end 44. The central portion 42 includes substantially all of the length of the flexible conduit 26 except for the small portions indicated as the propulsion end 40 and the input end 44. This flexible conduit may be made from any convenient thin-walled vinyl material which has good water-resistant properties and which may be rolled up when not in use without adversely affecting its flexible properties. Distributed along the central portion 42 are a plurality of tiny apertures (not shown to scale), hereinafter referred to as distributed jets 46T, from which a predetermined amount of pressurized water is discharged when in operation. The propulsion end 40 is specially formed to provide a pair of output jet streams 48A and 48B by means of a grommet like device 50 which is simply used to pinch together the ends of the flexible conduit 26 to form a pair of propulsion nozzles 52A and 52B. Hereinafter, this pair of output jet streams, 48A and 48B, and the pair of propulsion nozzles 52A and 52B will be referred to respectively as the bifurcated jet stream and the bifurcated propulsion nozzle. As before, when no confusion will result, these will be collectively referred to by reference numerals 48 and 52 respectively.

FIG. 2, a top view, shows only a single set of the plurality of distributed jets 46T, those arrayed in a line along the top side of the central portion 42 of flexible conduit 26. A second set of distributed jets 46B, are similarly arrayed along the bottom side of the conduit, as shown more clearly in FIG. 3. Experimentation has shown that the precise dimensions and distributions of the distributed jets 46T and 46B (hereinafter referred to collectively as distributed jets 46 when it is not critical to distinguish between the two locations) are not highly critical for the purposes of the present invention. It is important however, that there be a top and bottom array of distributed jets 46, and further that they remain positioned in a substantially vertical plane for the major portion of the time that the flexible conduits 26 are in dynamic use.

Under actual operating conditions, a portion of the source of pressurized water is routed into the input end 44 of flexible conduit 26 by way of one of the arms of the diversion valve 24. The pressurized water thereafter is discharged in predetermined ratios through the distributed jets 46, and the bifurcated propulsion nozzle 52. As the flexible conduit 26 is comparatively rigid in torsion, attaching the input end 44 to the diversion valve 24 such that the distributed jets 46 and vertically aligned, they will remain substantially so throughout normal dynamic operation. Thereafter, the two discharge means, the distributed jets 46 and the bifurcated propulsion nozzles 52 function as follows. The bifurcated jet stream 48 provides the primary propulsion means for the flexible conduit 26 by virtue of the reaction forces produced as the pressurized water is discharged therefrom. Taken by itself, this reactive force would tend to propel the propulsion end 40 in a random snake-like, sinuous manner with most of the motion confined to the propulsion end 40 and little or no motion imparted to the central portion 42. However, the bottom set of distributed jets 46B act so as to impart a slight positive buoyancy to flexible conduit 26 by virtue of the reactive forces generated by the pressurized water being discharged from a line of distributed jet stream 54B along the entire length of the central portion 42 through the bottom distributed jets 46B. Therefore, the central position 42 of the flexible conduit 26, being buoyed up so as to remain slightly above the bottom of the pool and experiencing comparatively little friction therewith, experiences the combined reactive forces of the distributed jet stream 54B and the bifurcated jet stream 48. These forces combine to provide a remarkable random sinuous motion which is highly efficient in converting the discharged pressurized water into vigorous motion of a major portion of the entire flexible conduit 26. It should be noted that the distributed jet stream 54B, in addition to imparting the net positive buoyancy to the flexible conduit 26, also provides a water scouring action thus dislodging silt and particulate matter which are caked to the bottom of the pool and putting it into suspension as well. Further, the top set of distributed jets 46T generate a line of distributed jet stream 54T directed vertically upwards which further agitates the water proximate the Flexible Conduit 26 and aids in establishing a generalized water current flow which transmits itself throughout the pool. Thus it is seen that the silt and particulate debris agitation is accomplished by a unique combination of forces. Summarizing, these are: 1) agitation by virtue of the bifurcated jet stream 48 in the region surrounding the bifurcated propulsion nozzle 52; 2) agitation, and a scouring (water scrubbing) action, by virtue of the distributed jet stream 54B exiting from distributed jets 46B; 3) agitation of the silt proximate the Flexible Conduit 26 by virtue of the vigorous relative motion as the flexible conduit 26 is sinuously propelled over the bottom regions of the pool; 4) further agitation and upward propulsion of the silt and particulate debris thus put into suspension by virtue of the line distributed jet stream 54T issuing from the distributed jets 46T.

In addition, experimentation has shown that the use of the bifurcated jet stream 48, which issues from bifurcated propulsion nozzle 52 in a substantially horizontal plane (the pair of jet streams being disposed at acute angles on opposite sides of an imaginary longitudinal line drawn through the extension of the Flexible Conduit 26), provides forces not completely understood quantitatively which substantially prevent stalling of the Flexible Conduit 26 as it approaches a vertical wall of the pool at a right angle. In previous experimental configurations of the invention, wherein only a single output nozzle was used on propulsion end 40, it was noted on occasion that when the flexible conduit 26 came slowly into a position where it was approximately at right angles to a vertical surface of the pool wall, there had been a tendency to reach a state of static equilibrium thereby causing the flexible conduit 26 to come to rest. While this happened only occasionally, and sometimes corrected itself, the problem presented a distinct reduction in pool cleaning efficiency. The bifurcated jet stream 48 substantially eliminates this stalling condition.

Figure 6:
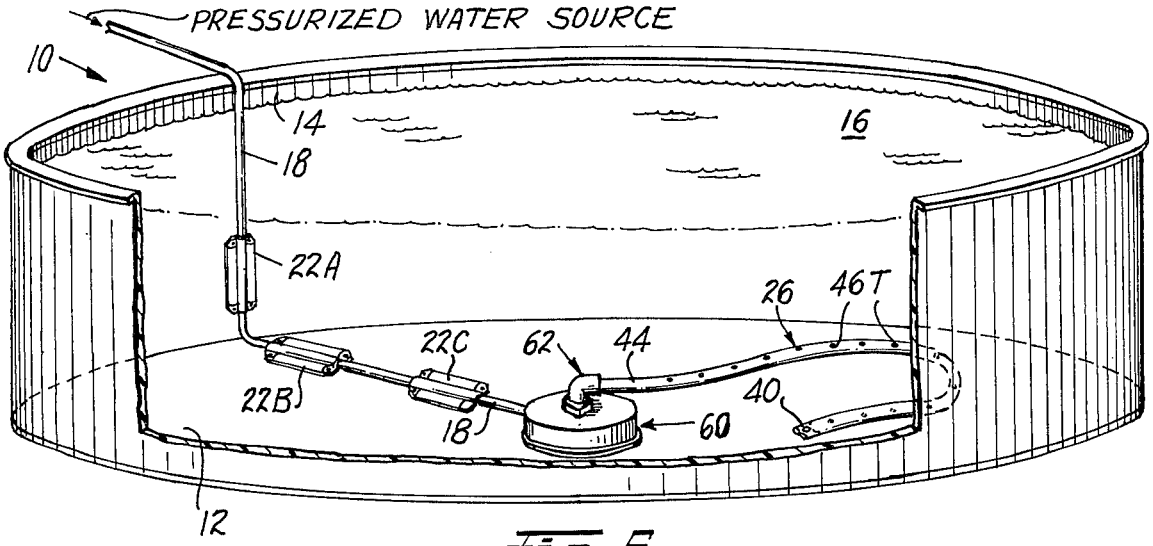
FIG. 6 is a perspective view, similar to FIG. 1, showing an alternate embodiment of the swimming pool cleaner of the present invention installed therein.

Referring now to FIG. 6, an alternate embdiment of the swimming pool cleaning apparatus in accordance with the present invention is shown. As before, a circular, above-ground swimming pool is pictured as an exemplary configuration, however the apparatus is equally suitable for use with a wide variety of pool shapes and types. The pool is indicated generally at 10, having a bottom 12, circular sides 14 and is filled to a convenient level with water 16. The major elements of this embodiment comprise a feedhose 18; a plurality of weight assemblies 22A-22C; a rotary assembly 60; and a single flexible conduit 26. It should be noted that the feedhose 18, the weight assemblies 22A-22C, and the flexible conduit 26 are identical in structure and function to their counterpart devices described in connection with the preferred embodiment of FIG. 1. This alternate embodiment functions similarly to the one previously described, the primary difference being the inclusion of the rotary assembly 60. As will be noted, this system is simplified in that it uses only a single flexible conduit 26. Also, it does not employ float and weight means for positioning the apparatus within the pool. Instead, the entire apparatus is properly positioned within the pool by placing the rotary assembly 60 nominally in the central zone of the pool. By virtue of the reactive forces generated by the discharge of pressurized water through the flexible conduit 26, as transmitted to the rotary assembly 60 via the input end 44, a low friction swivel 62 is caused to rotate. This rotation, coupled with the previously described vigorous sinuous motion of flexible conduit 26, causes the flexible conduit 26 to transverse the entire bottom region of the pool by a combination of snake-like motion of the propulsion end 40 and the rotary motion of the input end 44 provided by swivel 62. Also as previously described, the apparatus is highly efficient in converting the discharge of the pressurized water into random sinuous motion of the flexible conduit 26, and further in agitating the silt and particulate debris which accumulates on the bottom of the pool.

Figure 8:
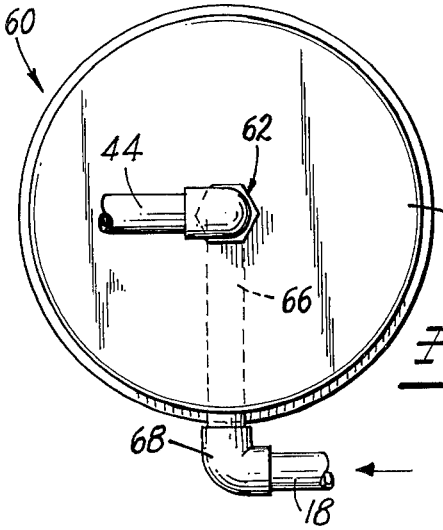
FIG. 8 is a fragmentary plan view of the rotary assembly for the embodiment illustrated in FIG. 6.
Figure 9:
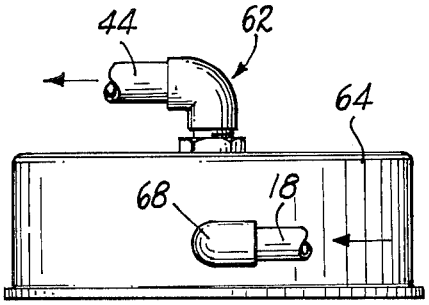
FIG. 9 is a side elevational view, partly inside, of the rotary assembly of FIG. 8.

FIGS. 8 and 9 show in slightly greater detail the construction of the rotary assembly 60. A negative buoyant base housing assembly 64 contains a straightforward pass through conduit section 66 which is coupled to the feedhose 18 via an elbow 68. Thereafter, the conduit 66 is coupled directly to the swivel 62 which may be of conventional design.

Figure 7:
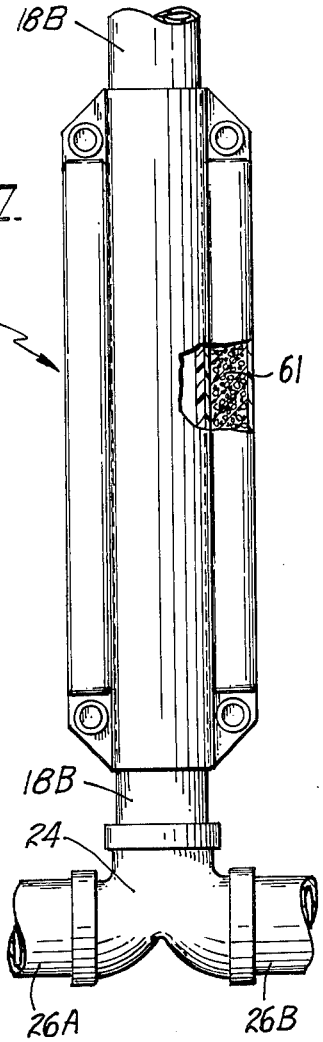
FIG. 7 is a fragmentary elevational view of the weight assembly, with a section broken away to show a portion of the water treating material contained therein.

Referring now to FIG. 7, the details of weight assembly 22 are shown. Weight assembly 22 has a hollow interior region through which the feedhose 18 is movably inserted, the relative dimensions being such that the feedhose 18, when pressurized, produces a tight frictional fit within the weight assembly 22. This arrangement provides both for ease of positional adjustment of the weight assembly 22 along the feedhose 18, and further for retaining the desired preset relative positions once established. The small cut away section of weight assembly 22 shows a pocket region containing a chemical 61 for use in treating the swimming pool water. Typically, this might be one of the more commonly used limestone mixtures, which mixture communicates with the swimming pool water over long periods of time and serves as an aid in maintaining the proper pH balance of the water.

Figure 5:
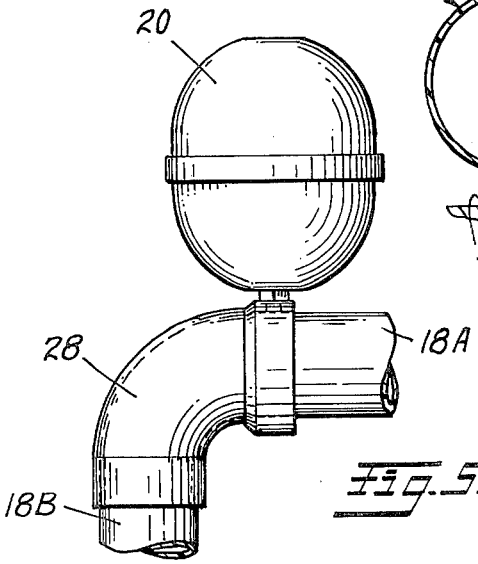
FIG. 5 is a fragmentary side elevation of the float assembly.

Referring now to FIG. 5, the details of the float assembly are shown. Briefly, float 20 remains substantially stationary and provides sufficient positive buoyancy to maintain the required portion of feedhose 18 afloat at the surface of the water. Feedhose 18 is movably inserted through the elbow-shaped retaining means 28, and is adjusted to the proper relative position. Thereafter, the tight frictional fit between retaining means 28 and feedhose 18, when pressurized, maintains the components in the desired, preset relative positions.

Additional embodiments of the present invention have been assembled using various combinations of the elements previously described. For example, larger pools, or pool of rectangular shape wherein the longer side is appreciably larger than the shorter side, may be cleaned by simply adding additional assemblies of either of the embodiments described in tandem. For the preferred embodiment, this would comprise two complete assemblies as shown in FIG. 1, wherein the two assemblies would be coupled to the source of pressurized water by a diversion valve similar to the type described as diversion valve 24. Also, for cleaning of large pools having different water depths at their opposite ends, the tandem arrangement would be accomplished merely by adjusting the lengths of feedhose 18B of the individual assemblies such that they were nominally equal to the depth of the water wherever positioned. To this end, it is sometimes desirable to make the length of the feedhose 18B slightly longer than the depth of the water such that the negative buoyancy provided by weight assembly 22 causes the diversion valve 24 to bear frictionally on the bottom of the pool. This prevents the creeping of the Diversion Valve 24 along the bottom of pools where a steep incline is experienced.

Although the invention has been described in terms of selected preferred embodiments, the invention should not be deemed limited thereto, since other embodiments and modifications will readily occur to one skilled in the art. It is therefore to be understood that the appended claims are intended to cover all such modifications as fall within the true spirit and scope of the invention.

What is claimed is:

1. A liquid agitation device particularly useful for maintaining swimming pool debris in suspension in a liquid for removal by the pool filtration system, which device comprises, in combination:

a. a flexible feed conduit for receiving a flow of pressurized liquid for discharge into the liquid;

b. at least one flexible agitation hose in fluid communication with the feed conduit, which agitation hose includes:

i. a bifurcated nozzle, formed by securing two opposed wall portions of the agitation hose together in abutting relationship, located at its distal end whereby the agitation hose is propelled within the liquid in a manner to preclude stalling of the agitation hose; and ii. a plurality of apertures disposed along the length of the agitation hose for discharging the pressurized fluid for agitating the debris; and c. means for positioning the feed conduit and agitation hose in the liquid.

2. The device of claim 1 wherein the opposed wall portions are secured together by means of a grommet.

3. The device of claim 1 wherein the plurality of apertures are disposed in two substantially parallel rows in opposing wall portions of the agitation hose.

4. The device of claim 1 wherein the means for positioning the feed conduit and agitation hose includes:

a. float means for supporting a first portion of the feed conduit in a substantially horizontal position on the surface of said liquid; and b. weight means for maintaining a second portion of the feed conduit in a substantially vertical position.

5. The device of claim 4 wherein the feed conduit includes an elbow connector and the float means is carried by the elbow connector.

6. The device of claim 4 wherein the weight means includes a container having at least one compartment for storing and distributing chemical material for treating the pool water, and means for removably attaching the container to the feed conduit.

7. The device of claim 1 wherein the means for positioning the feed conduit and agitation hose includes a tethering line carried by the feed conduit.

8. The device of claim 1 wherein the feed conduit includes a T-shaped connector carried adjacent the end thereof and an agitation hose connected to each outlet of the T-shaped connector.

9. The device of claim 1 wherein the means for positioning the feed conduit and agitation hose includes a base housing for supporting a portion of the feed conduit and agitation hose adjacent the bottom of the pool.

10. The device of claim 9 wherein the feed conduit includes weight means for maintaining a portion thereof adjacent the bottom of the pool, and wherein the weight means includes:

a. means for removable attachment to the feed conduit; and b. at least one compartment for storing and distributing chemical material for treating the pool water.

* * * * *